United States Patent [19]

Young

[11] Patent Number: 4,777,694

[45] Date of Patent: Oct. 18, 1988

[54] CLEANING APPLIANCE

[75] Inventor: Ronald A. Young, London, England

[73] Assignee: Steccone Products Company, Inc., Oakland, Calif.

[21] Appl. No.: 841,106

[22] Filed: Mar. 18, 1986

[30] Foreign Application Priority Data

Mar. 19, 1985 [GB] United Kingdom ..... 8507084

[51] Int. Cl.[4] ..... A47L 13/11

[52] U.S. Cl. ..... 15/245; 15/145

[58] Field of Search ..... 15/245, 150, 146, 117, 15/121, 145, 176, 236 R; 30/67

[56] References Cited

U.S. PATENT DOCUMENTS

| | | | |
|---|---|---|---|
| 1,478,339 | 12/1923 | Jayne . | |
| 2,123,638 | 7/1938 | Steccone | 15/245 |
| 2,261,475 | 11/1941 | Kautenberg | 15/245 |
| 2,440,099 | 4/1948 | Kind | 15/245 |
| 2,771,626 | 11/1956 | Toothman | 15/245 |
| 2,814,822 | 12/1957 | Page | 15/245 |
| 2,864,110 | 12/1958 | Bruger | 15/144 |
| 2,905,960 | 9/1959 | Ward | 15/245 |
| 3,110,052 | 5/1961 | Whitman | 15/117 |
| 3,892,005 | 7/1975 | Berns | 15/245 |
| 4,336,624 | 6/1982 | Pichelman | 15/245 |
| 4,697,296 | 10/1987 | Smahlik | 15/245 |

FOREIGN PATENT DOCUMENTS

| | | | |
|---|---|---|---|
| 86603 | 12/1921 | Austria . | |
| 97019 | 4/1898 | Fed. Rep. of Germany | 15/146 |
| 501604 | 7/1930 | Fed. Rep. of Germany | 15/146 |
| 3301775 | 9/1983 | Fed. Rep. of Germany . | |
| 572388 | 6/1924 | France | 15/245 |
| 215124 | 5/1924 | United Kingdom . | |
| 372558 | 5/1932 | United Kingdom . | |
| 658331 | 10/1951 | United Kingdom . | |
| 758185 | 10/1956 | United Kingdom . | |
| 1222538 | 2/1971 | United Kingdom | 15/245 |
| 1234375 | 6/1971 | United Kingdom . | |
| 1396559 | 6/1975 | United Kingdom . | |
| 1563433 | 3/1980 | United Kingdom . | |
| 2106583 | 3/1986 | United Kingdom . | |

*Primary Examiner*—Edward L. Roberts

*Attorney, Agent, or Firm*—Kathleen A. Skinner

[57] ABSTRACT

A cleaning appliance has a head portion 1 with a rearwardly projecting handle section 5, and presents at the front end opposed jaw members 2 and 3 between which a squeegee blade assembly 4, or another device such as a scraper blade or duster attachment, can be releasably clamped. The clamping arrangement comprises an operating level 8 disposed at a front upper surface 1*a* of the head portion 1 and positioned for single-handed operation by an operator using the thumb or forefinger of the hand in which the handle section is held.

12 Claims, 3 Drawing Sheets

CLEANING APPLIANCE

The invention relates to cleaning appliances such as squeegees or the like as commonly used for the cleaning of windows and/or floors, especially the former. In particular it relates to appliances which comprise a head portion with a projecting handle section and on which a squeegee blade or the like is mountable, with the blade projecting laterally and releasably gripped between opposed jaws of the head portion.

Various releasable clamping arrangment have been proposed for such appliances but all of them suffer from disadvantages of complexity, cumbersomeness, lack of strength and/or the impossibility or difficulty of single-handed operation. The last of these disadvantages is of particular importance with a squeegee when used by a window cleaner who may wish to release and re-clamp the squeegee blade whilst working on a high ladder. In such situations it is highly desirable, on the grounds of safety, that the clamping means should be operable by the hand holding the appliance so that the other hand does not have to let go of the ladder.

The object of the invention is to provide an appliance with a clamping arrangement which overcomes all, or at least some, of the disadvantages possessed by prior constructions.

To this end an appliance, according to one aspect of the invention, has a head portion with a rearwardly projecting handle section presently at the front end opposed jaws between which a laterally projecting squeegee blade or the like can be releasably clamped, the clamping arrangement further comprising an operating member disposed at a front upper surface of the head and which is suitably positioned for single-handed operation by an operator using the thumb or forefinger of the hand in which the handle section is held.

Preferably the operating member is pivotally or rotatably mounted on one of said jaws, for movement between an unclamping position (in which the blade is not gripped) and a clamping position in which it applies a jaw-closing force to the other of said jaws. Thus it may take the form of a lever, which is pivotable between said unclamping and clamping positions in the latter of which positions it engages said other jaw with a camming or eccentric action whereby to produce the jaw closing force to grip the blade. Alternatively, it may be the head of a clamping screw the screw-threaded stem of which engages a screw-threaded mounting on the upper jaw, which then provides said one jaw, with the end of the stem engaging the other lower jaw rearwardly of a connection between the jaws which allows the necessary relative angular movement thereof.

The operating member may be a lever which pivots between the unclamping position and the clamping position on a pivot pin disposed laterally of the head and supported by a projection extending from said one jaw and passing through a clearance aperture in said other jaw, the latter being engaged by the lever with a camming action as the lever moves to the clamping position.

Hence, according to another aspect of the invention, an appliance has a head portion presenting at the front end opposed jaw members between which a laterally projecting squeegee blade or the like can be gripped, a clamp operating member in the form of a lever being mounted for pivotal movement between unclamping and clamping positions on a projection from one of the jaw members which projects through an aperture in the other jaw member for mounting of the lever which, as it moves to the clamping position, engages the other jaw member with a camming action to apply a closing force between the jaw members.

The projection may be fixed to said one jaw member but in preferred constructions it is not so secured but comprises a stem which passes freely through an aperture in said one jaw member and presents a shoulder which engages the outer side of the latter. The shoulder may be provided by a self-locking nut screwed on to the stem. Preferably said other jaw member is the upper jaw member and is formed integrally with the handle section of the appliance, with said projecting stem securing the two jaw members together and the rear end of said one or lower jaw member engaging the upper jaw member to define a pivot axis for relative pivotal movement of the jaw members to the blade clamping position. Said camming action may be produced by an eccentric pivot boss of the lever which engages the outer surface of said other jaw member.

The appliance may include a squeegee blade retained along its rear edge in a metal support channel positioned between the jaws, and both jaws may engage and grip this channel. The upper limb of the channel may be extended towards the front edge of the blade and inclined away from the latter forwardly of the upper jaw to provide a stop surface limiting flexing of the blade during use, and in this case the lower jaw of the appliance may be designed to clear the channel and engage the blade itself so that the latter is gripped between the upper channel limb and the lower jaw. This serves to retain and locate the blade in the support channel, so that retaining means such as end clips for axial retention of the blade in the channel are not required.

It will be appreciated that as an alternative to a squeegee blade, in connection with which the invention is more particularly described herein, the head of the appliance may be fitted with other devices similarly gripped between the jaws. Thus the squeegee blade may be replaced by a scraper blade or a duster attachment, for example. The head may be adapted for the attachment of a washing device operative to supply water, or a cleaning solution, to the surface being cleaned during use of the appliance.

The invention will now be further described with reference to the accompanying drawings which illustrate, by way of example, a squeegee construction representing a preferred embodiment of the invention. In the drawings.

Figure 1:
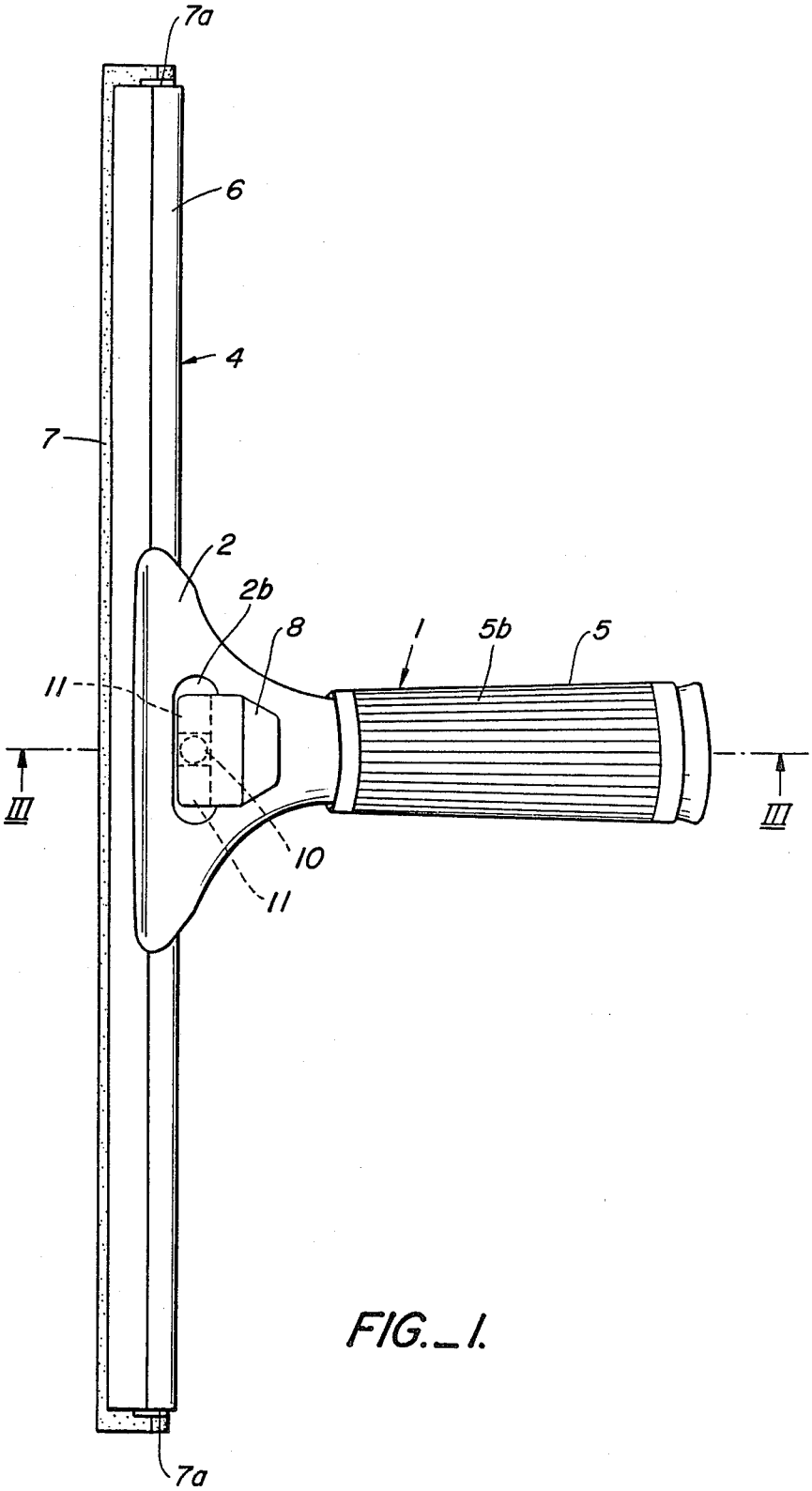
FIG. 1 is an upper face view of one embodiment.
Figure 2:
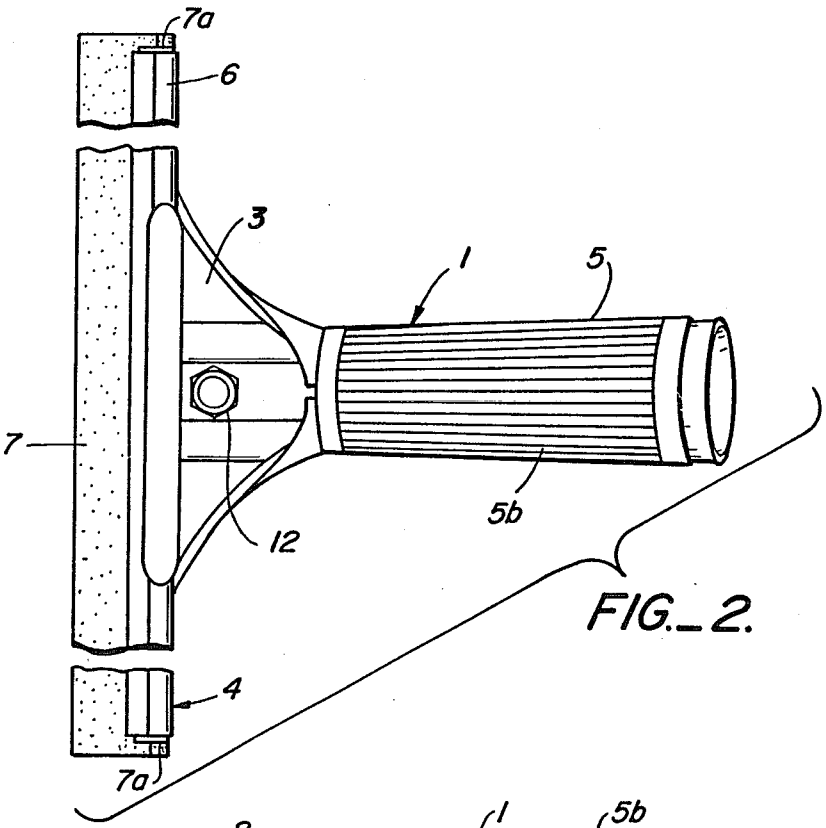
FIG. 2 is a corresponding lower face view.
Figure 3:
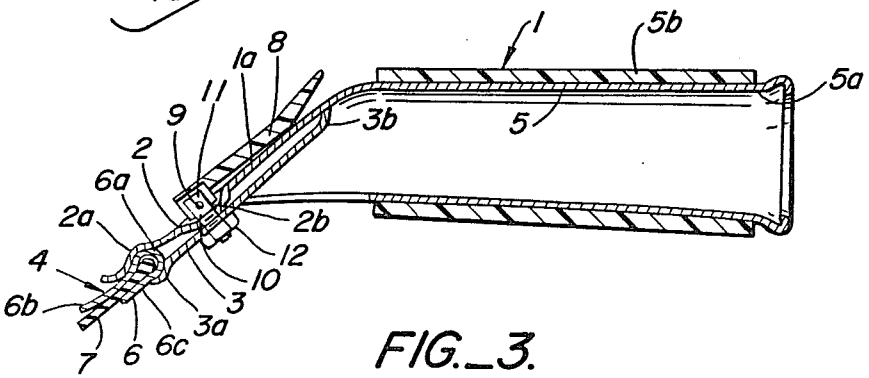
FIG. 3 is a cross-sectional view on the line III—III in FIG. 1.

Referring to FIGS. 1 to 3, the appliance which is illustrated therein comprises a head portion 1 presenting at the forward end upper and lower jaw members 2 and 3 between which a squeegee blade assembly 4 is removably gripped with a clamping action. When the jaws members 2 and 3 are in a relative unclamping position the laterally projecting squeegee blade assembly 4 is freely slidable between them, for lateral adjustment or for removal and replacement. The head portion 1 comprises a rearwardly projecting handle section 5, formed with the upper jaw member 2 as an integral sheet metal pressing with the handle section 5 rolled to provide a tapering tubular socket 5*a* allowing the head portion 1 to be mounted on an extension handle. A ribbed rubber sleeve 5*b* provides a handgrip when the section 5 is held in the hand of the user.

The squeegee blade assembly 4 is of basically conventional construction with a metal support channel 6 in which the rubber squeegee blade proper is fitted. The channel 6 has a part-spherical bulbous base section 6*a* by which it is gripped between concave gripping sections 2*a* and 3*a* of the jaw members 2 and 3. The blade 7 has a complementary cross-section so that it is retained by the shape of the channel 6, and it is replaceably retained and located in the longitudinal axial direction within the channel by end clips 7*a*.

Clamping means by which the jaw-closing force is applied between the jaw members 2 and 3 to grip the squeegee blade assembly 4 comprise an operating member in the form of a moulded plastics lever 8 disposed at the front upper surface 1*a* of the head portion 1 above the jaw member 2. It is mounted for pivotal movement, between unclamping and clamping positions (the latter of which is illustrated) on a laterally disposed pivot pin 9. The pin 9 is mounted in a cylindrical stem 10 which projects from the lower jaw member 3 through a clearance aperture in the upper jaw member 2. On each side of the stem 10 the lever 8 has a generally rectangular pivot boss 11 presenting an eccentric cam profile which engages the upper surface of the jaw member 2, within a laterally extending recessed portion 2*b* pressed therein, with a camming action to provide the jaw closing force in the position illustrated.

The stem 10 passes through a clearance aperture in the lower jaw member 3, and at the lower end is threaded to receive a self-locking nut 12. This nut 12 provides an abutment which engages the lower jaw member 3 to apply the jaw closing force thereto. The stem and nut assembly 10,12 thus interconnects the jaw members 2 and 3 in a manner which allows self-aligning relative movement thereof, and at the rear the lower jaw member 3 has an upturned end section 3*b* which engages the upper jaw member 2 to provide a pivot abutment for relative pivotal movement of the jaw members 2 and 3. The nut 12 allows the effective length of the stem 10 to be adjusted, to provide the required blade gripping force in the clamping condition. The shape of the pivot bosses 11 is such that if the lever is flipped up through 90° to the unclamping position, in which position it is self-retaining in a toggle-like manner, the jaw members 2 and 3 are are free to open sufficiently to release the blade assembly 4.

As shown in FIG. 3 the upper limb 6*b* of the channel 6 is extended towards the front edge of the blade 7 and inclined away from the latter forwardly of the upper jaw member 2 to provide a stop which limits flexing of the blade 7 in use. As can also be see from that figure both jaw members 2 and 3 directly engage and grip, respectively, the channel limbs 6*b* and 6*c*. Thus the end clips 7*a* are required for axial retention of the squeegee blade 7 in the channel 6.

Figure 5:
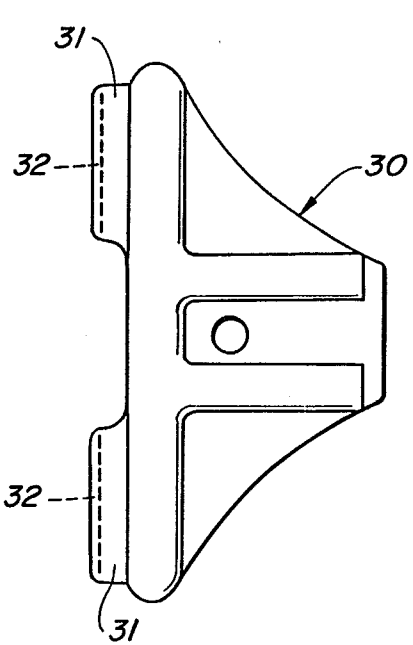
FIG. 5 is a detail view of the modification, from below.
Figure 4:
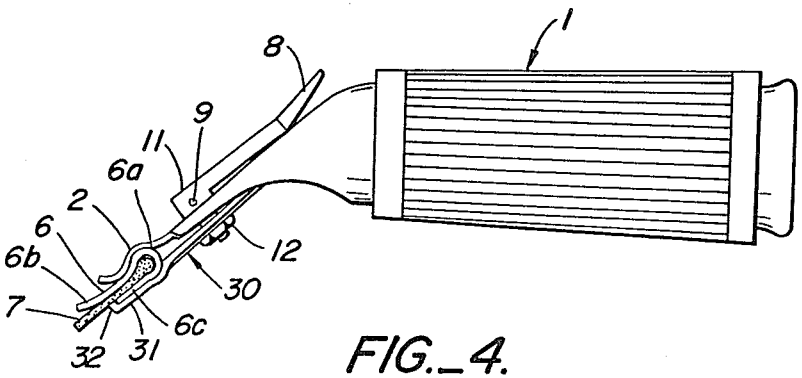
FIG. 4 is a side view showing a modification.

The modification illustrated in FIGS. 4 and 5 consists of a lower jaw member 30 which is a replacement for the jaw member 3 already described, all the other components of the appliance being unchanged. The jaw member 30 is identical with jaw member 3 except at its forwardly projecting end where the jaw pressing is extended by two spaced sections 31 which terminate in upwardly directed flanges 32. As shown in FIG. 4, in the clamping position the lower jaw member 30 clears the lower limb 6*c* of the support channel 6 and the flanges 32 engage the squeegee blade 7. Thus the blade 7 is directly clamped between the upper channel limb 6*b* and the flanges 32, so that clamping of the assembly 4 serves also to retain and locate the squeegee blade 4 in the axial direction within the channel 6. In view of this the end clips 7*a* shown in FIGS. 1 and 2 can, if desired, be dispensed with when the jaw member 30 is used.

The embodiments of the remaining figures are generally similar to that of FIGS. 1 to 3 except for the clamping arrangements, and thus where appropriate they utilise for similar parts the same reference numerals as the earlier figures. In particular, these embodiments utilise the same squeegee blade assembly as shown in FIGS. 1 to 3.

Figure 6:
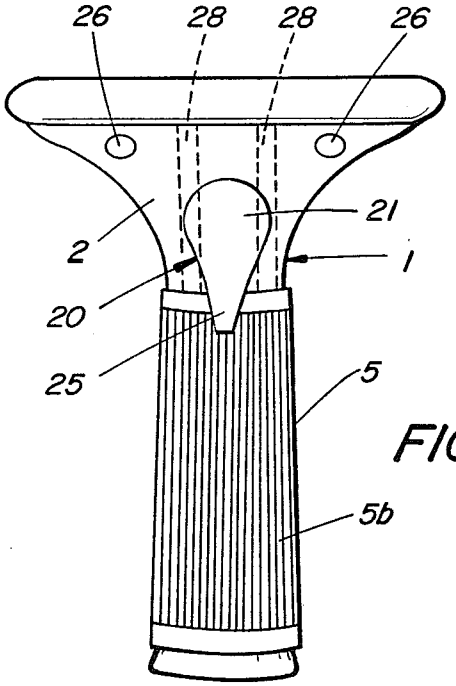
FIG. 6 is a top plan view of another embodiment of the head portion of the invention.
Figure 7:
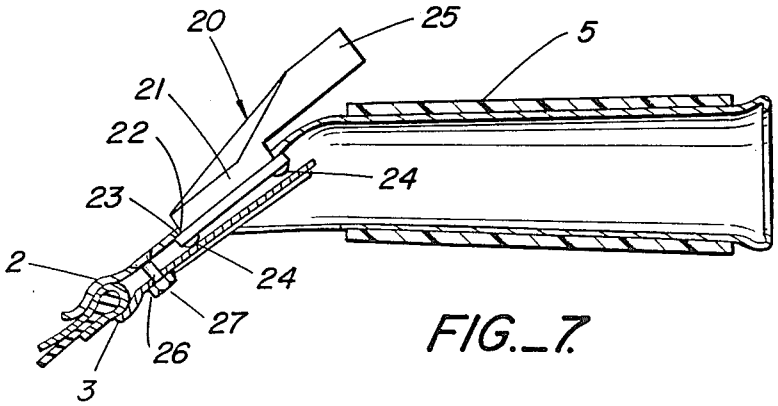
FIG. 7 is a fragmentary cross-sectional view of the embodiment of FIG. 6, with a squeegee blade in place.

FIGS. 6 and 7 are an upper face view (with the squeegee blade removed) and a fragmentary cross-sectional view of a further embodiment in which the clamping arrangement has an operating member which is again in the form of a moulded plastic lever 20 mounted on the upper jaw member 2. However, in this case the lever 20 pivots about an axis normal to the upper surface of the jaw member 2. It has a mounting boss 21 which takes a bearing in a circular aperture 22. The boss 21 is stepped to provide a shoulder 23 which engages the lower surface of the jaw member 2 to retain lever 20, and it presents two diametrically opposed radiused cam projections 24 on it lower surface. The lever 20 has a rearwardly projecting arm 25 by which it can be operated, by the thumb or forefinger of a hand in which the handle section 1 is held, being turnable in either direction from the clamping position illustrated to an unclamping position. The arm 25 is of a shape which enables it to be threaded through the aperture 22 for fitting of the lever 20 therein. The jaw members 2 and 3 are secured together by two laterally spaced screws 26 with countersunk heads recessed into the upper jaw member 2. Self-locking nuts 27 on the screws 26 enable the effective length of the latter to be adjusted to provide the required jaw closing force when the cam projections 24 engage the jaw member 3 as shown. This jaw member 3 has two pressed recesses 28 which the projections 24 enter when the lever 20 is turned through 90° to an unclamping position, thereby allowing free separating movement of the jaw members 2 and 3 to release the squeegee blade assembly. The screws 26 provide a self-aligning interconnection of the jaw members 2 and 3 which also permits the required relative angular movement between the clamping and unclamping positions.

Figure 8:
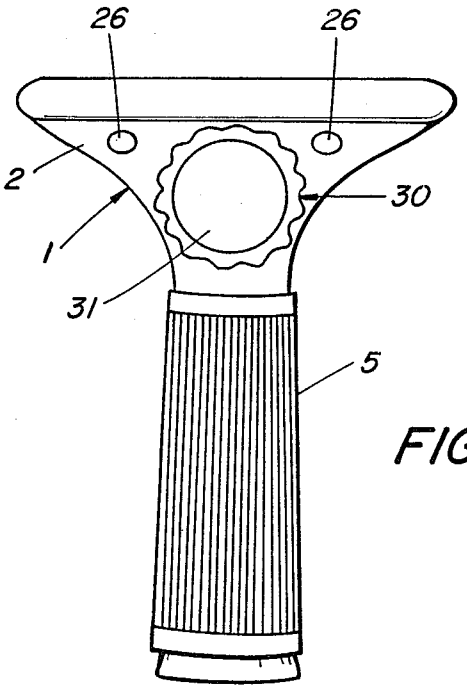
FIG. 8 is a top plan view of another embodiment of the head portion of the squeegee.
Figure 9:
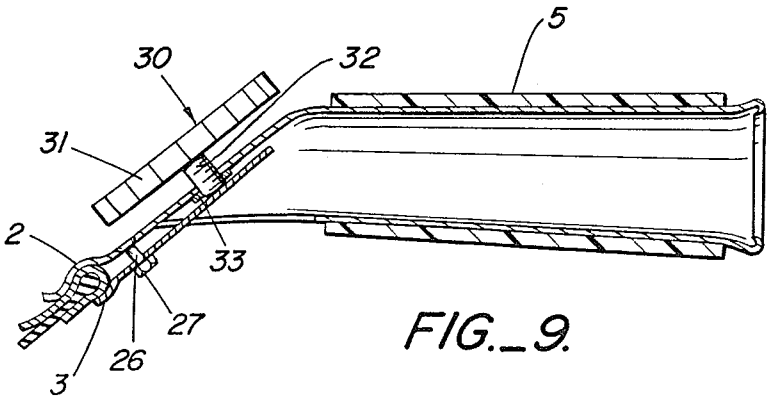
FIG. 9 is a fragmentary cross-sectional view of the embodiment of FIG. 6, with a squeegee blade in place.

FIGS. 8 and 9 are an upper face view (with the squeegee blade removed) and a fragmentary cross-sectional view of yet a further embodiment in which the two jaw members 2 and 3 are again secured together by the two laterally spaced screws 26 with self-locking nuts 27. However, in this case the clamping arrangement employs a clamping screw with a large moulded-on plastics head 31 which provides the operating member. The head 31 has edge serrations which facilitate the single handed thumb or forefinger operation as before. The threaded stem 32 of the screw 30 engages a mounting in the upper jaw member 2, from which it projects for engagement with the upper surface of the lower jaw member 3 rearwardly of the screws 26. Thus screwing-in of the screw 30 produces relative angular movement of the jaw members 2 and 3 in the closing direction to grip the blade assembly 4 between them. In this case the extent to which the screw 30 is tightened determines the jaw closing of clamping force.

I claim:

1. A squeegee having a head portion with a rearwardly projecting handle section and presenting at the front end opposed jaws between which a laterally projecting squeegee blade or the like is releasably secured by clamping means, the clamping means comprising a clamp operating member in the form of a lever disposed at a front upper surface of the head portion, and suitably positioned for single-handed operation to a clamping position by downward pressure or to an unclamping position by upward pressure applied by an operator to the rearward portion of said lever using the thumb or forefinger of the hand in which the handle section is held, said clamp operating member being pivotally mounted on one of said jaws on a pivot pin disposed laterally of the head, said pivot pin being supported by a stem projecting through an aperture in said upper jaw and passing through an aperture in said lower jaw, said stem presenting a shoulder which engages the outer side of said lower jaw member, said clamp operating member engaging the surface of said upper jaw with a camming action and said jaws moving toward each other as the clamp operating member moves to the clamping position, and restraining means whereby said clamp operating member is limited to a range of movement of approximately 90°.

2. The squeegee of claim 1 wherein the upper jaw member is formed integrally with the handle section of the squeegee and said projecting stem secures the two jaw members together and the rear end of the lower jaw member engages the upper jaw member to define a pivot axis for relative pivotal movement of the jaw members to the blade clamping position.

3. The squeegee of claim 2 wherein an eccentric pivot boss of the lever engages the outer surface of said upper jaw member to provide said camming action.

4. A squeegee having a head portion with a rearwardly projecting handle section and opposed jaws at the front end of the head portion between which a laterally projecting squeegee support channel holding the squeegee blade can be gripped, and clamping means comprising a clamping member in the form of a lever pivotally mounted and limited to a range of movement of approximately 90° on the front upper surface of the upper jaw, said upper jaw being integrally formed with said handle, said clamping member being mounted on a pivot pin disposed laterally of the head portion, said pivot pin being mounted in a stem projecting through an aperture in one jaw member, said projecting stem being secured by securement means to the other jaw member whereby said projecting stem connects the two jaw members to each other, the rear end of the lower jaw member engaging the upper jaw member to define a pivot axis for relative pivotal movement of the jaw members to the clamped position, and an eccentric pivot boss of the lever journalling said pivot pin and engaging the outer surface of the upper jaw member with a camming action to provide a closing force on said support channel disposed between said jaw members when said lever is moved from an unclamped to a clamped position.

5. The squeegee of claim 4 wherein said lever has a generally rectangular pivot boss on each side of said projecting stem, said bosses engaging the upper surface of said upper jaw in an unclamped position whereby the jaws open sufficiently to release the squeegee support channel and blade and the movement of the lever is limited to approximately 90° from the clamped position.

6. The squeegee of claim 4 wherein said pivot boss engages a laterally extending recessed portion of the upper surface of said upper jaw.

7. The squeegee of claim 4 wherein said projecting stem passes freely through an aperture in said other jaw member and presents a shoulder which engages the outer side of said other jaw member and secures said stem thereto to interconnect said jaw members.

8. The squeegee of claim 7 wherein said shoulder is provided by a self-locking nut screwed onto the stem whereby the effective length of the stem connecting the two jaws can be adjusted to adjust the closing force on the support channel.

9. The squeegee of claim 4, 5, 6, 7 or 8 wherein the squeegee blade is retained along its rear edge in a support channel positioned between the jaws, with an upper limb of the channel extended towards the front edge of the blade relative to a lower limb of the channel, the lower jaw of the squeegee being formed so as to clear the channel and to engage the blade itself, whereby the blade is gripped between the upper channel limb and the lower jaw.

10. A squeegee having a flared head portion with a rearwardly projecting handle section and opposed upper and lower jaws at the front end of the head portion between which a laterally projecting squeegee support channel holding the squeegee blade can be gripped, wherein said upper jaw is integrally formed with said handle, a clamping member in the form of a lever is pivotally mounted on the front upper surface of the upper jaw on a pivot pin disposed laterally of the head portion, said pivot pin is mounted in a stem projecting through an aperture in said upper jaw member, said projecting stem passes through an aperture in said lower jaw member and is secured on the outer side of said lower jaw by a shoulder whereby said stem interconnects said jaw members, the rear end of said lower jaw engaging the upper jaw to define a pivot axis for relative pivotal movement of the jaw members to the clamped position, and said lever has a generally rectangular pivot boss on each side of said projecting stem, said bosses engaging the outer surface of the upper jaw member with a camming action whereby when said lever is moved from a clamped to an unclamped position said jaws release their closing force on said support channel disposed therebetween.

11. The squeegee of claim 10 wherein said upper jaw includes a laterally extending recessed portion on its upper support channel positioned between the jaws, with an upper surface for engagement with said pivot bosses.

12. The squeegee of claim 10 or 11 wherein the squeegee blades is retained along its rear edge in a metal limb of the channel extended towards the front edge of the blade relative to a lower limb of the channel, the lower jaw of the squeegee being formed so as to clear the channel and to engage the blade itself, whereby the blade is gripped between the upper channel limb and the lower jaw.

* * * * *

UNITED STATES PATENT AND TRADEMARK OFFICE

CERTIFICATE OF CORRECTION

PATENT NO. : 4,777,694

DATED : October 18, 1988

INVENTOR(S) : Ronald A. Young

It is certified that error appears in the above—identified patent and that said Letters Patent is hereby corrected as shown below:

Col. 1, line 12, "arrangement" should be --arrangements--.

Col. 3, line 1, "jaws" should be --jaw--.
line 64, "see" should be --seen--.

Col. 6, lines 58-59, delete "support channel positioned between the jaws, with an upper".
line 61, "blades" should be --blade--.
line 61, after "metal", insert --support channel positioned between the jaws, with an upper--.

Signed and Sealed this

Eleventh Day of April, 1989

*Attest:*

*Attesting Officer*

DONALD J. QUIGG

*Commissioner of Patents and Trademarks*